US006087544A

United States Patent [19]

Wittenbrink et al.

[11] Patent Number: 6,087,544

[45] Date of Patent: Jul. 11, 2000

[54] PROCESS FOR THE PRODUCTION OF HIGH LUBRICITY LOW SULFUR DISTILLATE FUELS

[75] Inventors: Robert J. Wittenbrink; Darryl P. Klein; Michele S. Touvelle; Michel Daage, all of Baton Rouge, La.; Paul J. Berlowitz, East Windsor, N.J.

[73] Assignee: Exxon Research and Engineering Co., Florham Park, N.J.

[21] Appl. No.: 09/074,270

[22] Filed: May 7, 1998

[51] Int. Cl.[7] ..... C10L 1/08

[52] U.S. Cl. ..... 585/14; 44/300

[58] Field of Search ..... 585/14; 44/300

[56] References Cited

U.S. PATENT DOCUMENTS

| | | | |
|---|---|---|---|
| 4,723,963 | 2/1988 | Taylor | 44/300 |
| 4,846,959 | 7/1989 | Kennedy et al. | 208/97 |
| 4,864,067 | 9/1989 | Harandi et al. | 585/254 |
| 5,389,111 | 2/1995 | Nikanjam et al. | 44/300 |
| 5,389,112 | 2/1995 | Nikanjam et al. | 44/300 |
| 5,405,417 | 4/1995 | Cunnigham | 44/322 |
| 5,451,312 | 9/1995 | Apelian et al. | 208/143 |
| 5,792,339 | 8/1998 | Russell | 208/15 |

*Primary Examiner*—Ellen M. McAvoy
*Attorney, Agent, or Firm*—Henry E. Naylor

[57] ABSTRACT

A process for producing distillate fuels, such as diesel fuels and jet fuels having both high lubricity and low sulfur levels. Such fuels are produced by fractionating a distillate feed-stream into a light fraction which is relatively low in lubricity and which contains from about 50 to 100 wppm of sulfur and a heavy fraction having a relatively high lubricity. The first fraction is hydrotreated to remove substantially all of the sulfur and is then blended with the second fraction to produce a distillate fuel product having relatively low sulfur levels and a relatively high lubricity.

4 Claims, 2 Drawing Sheets

PROCESS FOR THE PRODUCTION OF HIGH LUBRICITY LOW SULFUR DISTILLATE FUELS

FIELD OF THE INVENTION

The present invention relates to a process for producing distillate fuels, such as diesel fuels and jet fuels, having both high lubricity and low sulfur levels. Such fuels are produced by fractionating a distillate feedstream into a light fraction which is relatively low in lubricity but which contains from about 50 to 100 wppm of sulfur and a heavy fraction having a relatively high lubricity and the balance of the sulfur. The light fraction is hydrotreated to remove substantially all of the sulfur and is then blended with at least a portion of the second fraction to produce a distillate fuel product having a relatively low sulfur level and a relatively high lubricity.

BACKGROUND OF THE INVENTION

There is a continuing need to produce fuels that meet the ever stricter requirements of regulatory agencies around the world. Of particular need are fuels that have relatively low levels of aromatics and sulfur. While regulated fuel properties are not identical for all regions, they are generally achieved by the use of hydroprocessing (hydrotreating) to lower the levels of both aromatics and sulfur. Hydrotreating, particularly hydrodesulfurization, is one of the fundamental processes of the refining and chemical industries. The removal of feed sulfur by conversion to hydrogen sulfide is typically achieved by reaction with hydrogen over non-noble metal sulfides, especially those of Co/Mo, Ni/Mo and Ni/W, at fairly rigorous temperatures and pressures to meet product quality specifications. Environmental considerations and mandates have driven product quality specifications in the direction of lower sulfur and aromatics levels.

Currently, the maximum allowable sulfur level for U.S. on-road diesel is 500 wppm. All countries in the European Community have instituted maximum sulfur levels of 500 wppm. In some European countries diesel fuels having even lower sulfur levels are produced. For example, Swedish Class I and Class II diesel fuels currently allow maximum sulfur levels of 10 and 50 wppm, respectively. It seems very likely that other European countries will move to the <500 wppm sulfur fuels in the foreseeable future.

Environmental and regulatory initiatives are also requiring lower levels of total aromatics in hydrocarbons and, more specifically, lower levels of the multi-ring aromatics found in distillate fuels and heavier hydrocarbon products (i.e., lubes). The maximum allowable aromatics level for U.S. on-road diesel, California Air Resources Board (CARB) reference diesel and Swedish Class I diesel are 35, 10 and 5 vol. %, respectively. Further, the CARB reference diesel and Swedish Class I diesel fuels allow no more than 1.4 and 0.02 vol. % polyaromatics, respectively.

During hydrotreating, aromatics are saturated and feed sulfur is converted to hydrogen sulfide. While this achieves the desired result with respect to emissions, it has an adverse affect on the inherent lubricity properties of the distillate fuel. This lower lubricity leads to increased maintenance costs of diesel engines, e.g., pump failures, and in extreme cases to catastrophic failure of the engine. Consequently, there is a need in the art for processes that can produce distillate fuels that meet current emissions requirements with regard to low aromatics and sulfur, but which have good inherent lubricity properties.

SUMMARY OF THE INVENTION

In accordance with the present invention, there is provided a process for producing a distillate fuel product having less than about 500 wppm sulfur and a lubricity characterized by a wear scar diameter of less than about 400$\mu$ as measure by The High Frequency Reciprocating Rig Test from a distillate feedstream having a sulfur content up to about 2,000 wppm, which process comprises hydrodesulfurizing said stream to a level of less than about 1,000 wppm: (i) fractionating said distillate feedstream into a light fraction and a heavy fraction, said light fraction containing less than about 100 wppm sulfur; and said heavy fraction containing the balance of sulfur; (ii) hydrotreating said light fraction in the presence of a hydrotreating catalyst having hydrodesulfurization activity, and at hydrotreating conditions, thereby producing a light fraction which is substantially free of sulfur; and (iii) blending said hydrotreated light fraction with said heavy fraction, thereby resulting in a distillate stream having less than about 500 wppm sulfur and having relatively high lubricity.

In a preferred embodiment of the present invention the distillate feedstream is a diesel fuel stream boiling in the range of about 160° to about 400° C.

In another preferred embodiment of the present invention the distillate feedstream is a jet fuel stream boiling in the range of about 180° to about 300° C.

In still another preferred embodiment of the present invention the light fraction contains less than about 100 wppm sulfur and represents a boiling range cut of from the initial boiling point of the stream to about 70 vol. %.

DETAILED DESCRIPTION OF THE INVENTION

Figure 1:
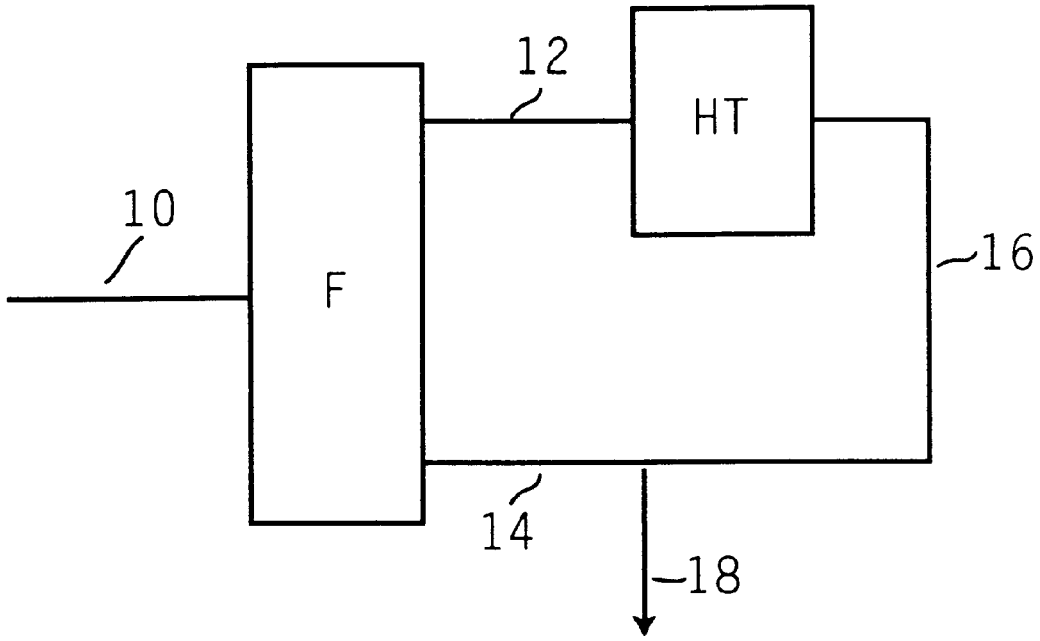
FIG. 1 is a schematic flow plan of a non-limiting preferred embodiment of the present invention.

Feedstocks which are suitable for being processed in accordance to the present invention are those petroleum streams boiling in the distillate range and above. Non-limiting examples of such streams include diesel fuels, jet fuels, heating oils, kerosenes, and lubes. Such streams typically have a boiling range from about 150 to about 600° C., preferably from about 160 to about 400° C., and most preferably from about 175 to 350° C. Non-limiting examples of preferred distillate streams are those boiling in the 160–400° C. range, although the trend, particularly in Europe and in California is for lighter diesel fuels. For example, Swedish Class I diesel has a T 95% of 250° C. while the Class II has a T 95% of 295° C. and have no more than about 50 wppm sulfur and less than 10 wt. % aromatics, based on the total weight of the fuel. T 95% means that 95% of the stream boils up to the designated temperature. Also, commercial jet fuels, which are included in the definition of distillate streams of this invention are generally classified by ASTM D 1655 and include: narrow cut Jet Al, a low freezing point variation of Jet A; and wide cut Jet B. similar to JP-4. Jet fuels and kerosene fuels can be generally classified as fuels boiling in the range of about 180–300° C.

These streams may be obtained from normal petroleum sources as well as from synthetic fuels, such as hydrocarbons obtained from shale oils. Fuels from normal petroleum sources are generally derived from their appropriate distillate streams and may be virgin stocks, cracked stocks, or a mixture thereof. The sulfur content of the source streams typically ranges from about 0.7 wt. % to about 2 wt. %. It is preferred that the streams first be hydrotreated to reduce sulfur contents, preferably to less than about 1,000 wppm sulfur.

This invention describes a unique process wherein a significant amount of the inherent lubricity of the fuel is maintained while the sulfur level and the aromatics level are substantially reduced. More particularly, a distillate boiling range stream of the present invention is fractionated such that a high lubricity higher boiling fraction and a lower boiling lower lubricity fraction are separated via distillation. The low lubricity fraction is processed to remove essentially all of the sulfur and aromatic species. The two streams, or at least a portion of the two streams, are then blended together yielding a low sulfur, low aromatic distillate product stream having high lubricity.

Reference is now made to the figure wherein the distillate stream, which contains less than about 1,000 wppm sulfur, is fed via line 10 to fractionator F to produce a light fraction having relatively low lubricity and sulfur and a heavy fraction, having a relatively high lubricity and the remaining sulfur. The light fraction exits the fractionator via line 12 and the heavy fraction via line 14. The light fraction is passed to hydrotreater HT where is it hydrotreated in the presence of a hydrotreating catalyst to remove heteroatoms, particularly sulfur and to saturate aromatics. This light fraction will typically represent that portion of the stream that contains less than about 100 wppm, preferably less than about 50 wppm, and more preferably less than about 25 wppm sulfur.

The light fraction will also contain less than about 100 wppm sulfur, typically from about 50 to 100 wppm sulfur. Suitable hydrotreating catalysts for use in the present invention are any conventional hydrotreating catalyst used in the petroleum and petrochemical industries. A common type of such catalysts are those comprised of at least one Group VIII metal, preferably Fe, Co and Ni, more preferably Co and/or Ni, and most preferably Ni; and at least one Group VI metal, preferably Mo and W, more preferably Mo, on a high surface area support material, such as alumina, silica alumina, and zeolites. The Group VIII metal is typically present in an amount ranging from about 2 to 20 wt. %, preferably from about 4 to 12%. The Group VI metal will typically be present in an amount ranging from about 5 to 50 wt. %, preferably from about 10 to 40 wt. %, and more preferably from about 20 to 30 wt. %. All metal weight percents are on support. By "on support" we mean that the percents are based on the weight of the support. For example, if the support were to weigh 100 g. then 20 wt. % Group VIII metal would mean that 20 g. of Group VIII metal was on the support. Typical hydroprocessing temperatures will be from about 100° C. to about 450° C. at pressures from about 50 psig to about 2,000 psig, or higher.

Other suitable hydrotreating catalysts include noble metal catalysts such as those where the noble metal is selected from Pd, Pt, Pd and Pt and bimetallics thereof. It is within the scope of the present invention that more than one type of hydrotreating catalyst be used in the same bed.

Suitable support materials for the catalysts of the present invention include inorganic refractory materials, such as alumina, silica, silicon carbide, amorphous and crystalline silica-aluminas, silica magnesias, alumina-magnesias, boria, titania, zirconia and mixtures and cogels thereof. Preferred support materials include alumina, amorphous silica-alumina, and the crystalline silica-aluminas, particularly those materials classified as clays or zeolitesl. The most preferred crystalline silica-aluminas are controlled acidity zeolites modified by their manner of synthesis, by the incorporation of acidity moderators, and post-synthesis modifications such as dealumination.

The hydrotreated stream, which now contains substantially no sulfur, leaves the hydrotreater HT via line 16 and is blended with the heavy fraction of line 14 to produce a blended stream via 18. This heavy fraction, which contains the balance of the sulfur components, also is a high lubricity fraction, and when blended with the substantially zero sulfur light fraction results in a stream which is relatively low in sulfur, but which has relatively high lubricity.

The following examples will serve to illustrate, but not to limit, this invention:

EXAMPLE 1

A diesel fuel feedstream consisting of hydrotreated 60% LCCO/40% virgin distillate was distilled into two fractions. The light fraction represents 70 vol. % of the total material. Physical properties and chemical compositions of the feed and the two fractions are listed in Table I below.

TABLE 1

| Sample | Feed | Light Fraction (IBP[1]-70 vol %) | Heavy Fraction (70–100 vol %) |
|---|---|---|---|
| °API Gravity | 27.1 | 30.5 | 19.9 |
| Viscosity @ 40° C., cSt | 3.51 | 1.94 | 10.89 |
| Sulfur, wppm | 663 | 28 | 2000 |
| Nitrogen, wppm | 333 | 25 | 1037 |
| Distillation | | | |
| IBP/5 | 249/378 | 242/353 | 553/580 |
| 10/20 | 422/467 | 394/431 | 594/610 |
| 30/40 | 499/524 | 458/481 | 624/638 |
| 50/60 | 549/575 | 499/515 | 651/666 |
| 70/80 | 605/641 | 532/548 | 681/700 |
| 90/95 | 689/720 | 570/585 | 727/751 |
| 99.5/FBP[2] | 788/826 | 615 | 877 |
| Aromatics, wt. % | 51.7 | 44.6 | 56.0 |
| Saturates, wt. % | 48.4 | 55.4 | 44.0 |

[1]IBP - initial boiling point
[2]FBP = final boiling point

EXAMPLE 2

A reactor was charged with a mixed bed of 2.36 g of a commercial 0.6 wt. % Pt on alumina catalyst and 5.01 g of a commercial ZnO. The mixed bed was reduced overnight at 300° C., 500 psig, and 50 cc/min 112. The light fraction was then introduced into said reactor and hydrotreated at a temperature about 250° C., 500 psig, 3000 SCF/B $H_2$ and 1.0 liquid hourly space velocity, wherein SCF/B is standard cubic feet per barrel. The resulting treated light fraction contained 2 wppm S and 1.75 wt. % aromatics.

EXAMPLE 3

A High Frequency Reciprocating Rig (HFRR) was used to determine the lubricating ability of the diesel fuels and diesel fuel blend stocks. This test was developed at the Department of Mechanical Engineering, Imperial College, London. The machine uses an electromagnetic vibrator to oscillate a moving specimen over a small amplitude under a constant load against a fixed specimen. The lower fixed specimen is held in a bath that contains the test fuel. A wear scar is formed which is measured and is used to assess the lubricity of the test fuel. In addition, the frictional force transmitted between the two specimens is measured. A working group of the International organization of Standardization (ISO), in cooperation with Coordinating European Council (CEC) has conducted a round robin test program to compare laboratory bench tests to evaluate the lubricity characteristics of diesel fuels. Their conclusions led to the selection of the High Frequency Reciprocating Rig Test (HFRR), ISO Provisional Standard TC22/SC7N595, as the proper screening tool for lubricity evaluations of diesel fuels. The test consists of a ball moving in a reciprocating motion over a stationary disk. The ball moves at 50 Hz over a stroke length of 1 mm for 75 minutes at 60° C. when testing distillate fuel. The wear scar on the disk is measured to the nearest micron in a microscope with the current proposed European standard of 460 microns as the largest allowable wear scar.

Six fuels were evaluated in the HFRR unit:

Fuel #1) Total feed from Example 1.

Fuel #2) Light fraction of feed from Example 1.

Fuel #3) Heavy fraction of feed from Example 1.

Fuel #4) The hydrotreated light fraction-Example 2.

Fuel #5) A severely hydrotreated distillate fuel.

Fuel #6) Blend of 15 wt. % Fuel #3 and 85 wt. % Fuel #4

The properties of these test fuels are summarized in Table 2 below.

TABLE 2

| | Fuel #1 | Fuel #2 | Fuel #3 | Fue1 #4 | Fuel #5 | Fuel #6 |
|---|---|---|---|---|---|---|
| °API Gravity | 27.1 | 30.5 | 19.9 | 35.3 | 33.2 | 32.9 |
| Viscosity @ 40° C., cSt | 3.51 | 1.94 | 10.89 | 2.62 | 2.53 | 3.03 |
| Sulfur, wppm | 663 | 28 | 2000 | 2 | <1 | 310 |
| Nitrogen, wt. % | 333 | 25 | 1037 | 4 | <1 | 171 |
| Distillation | | | | | | |
| IBP/5 | 249/378 | 242/353 | 553/580 | 246/345 | 221/338 | |
| 10/20 | 422/467 | 394/431 | 594/610 | 385/418 | 388/408 | |
| 30/40 | 499/524 | 458/481 | 624/638 | 446/470 | 418/431 | |
| 50/60 | 549/575 | 499/515 | 651/666 | 488/505 | 446/461 | |
| 70/80 | 605/641 | 532/548 | 681/700 | 522/542 | 480/498 | |
| 90/95 | 689/720 | 570/585 | 727/751 | 568/586 | 520/532 | |
| 99.5/FBP | 788/826 | 615 | 877 | 640 | 551 | |
| Aromatics, wt. % | 51.7 | 44.6 | 56.0 | 1.8 | 0.6 | 12.5 |
| Saturates, wt. % | 48.4 | 55.4 | 44.0 | 98.2 | 99.4 | 87.5 |

Figure 2:
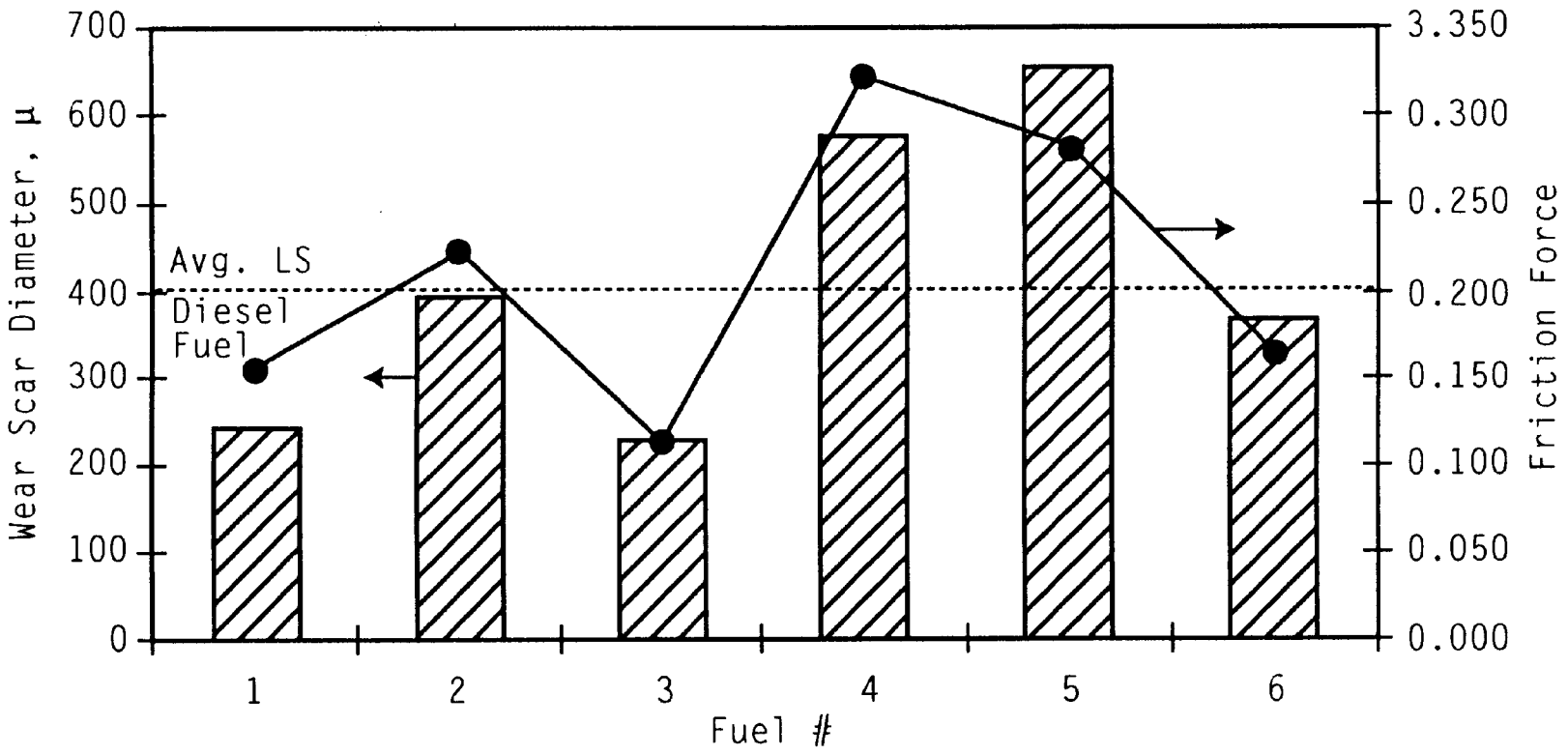
FIG. 2 is a graphical representation of the results of the High Frequency Reciprocating Rig test.

The test conditions used in the HFRR are summarized in Table 3 below and the results are summarized in FIG. 2 hereof. Typical low sulfur diesel fuels as described previously will have a wear scar diameter well above the proposed target of 400 $\mu$ and a friction force above 200. The results shown below clearly show that the product of this present invention, Fuel #6, has superior lubricity reflected in the low wear scar diameter and friction force.

TABLE 3

| HFRR Run Conditions | |
|---|---|
| Temperature, ° C. | 60 |
| Load, grams | 200 |
| Frequency, Hz | 50 |
| Stroke, $\mu$ | 1000 |

What is claimed is:

1. A process for producing a distillate fuel product having less than about 500 wppm sulfur and a lubricity characterized by a wear scar diameter of less than about 400 $\mu$ as measure by The High Frequency Reciprocating Rig Test from a distillate feedstream having a sulfur content up to about 2,000 wppm, which process comprises hydrodesulfurizing said stream to a level of less than about 1,000 wppm sulfur; followed by: (i) fractionating said distillate feedstream into a light fraction and a heavy fraction, said light fraction containing less than about 100 wppm sulfur; and said heavy fraction containing the balance of sulfur; (ii) hydrotreating said light fraction in the presence of a hydrotreating catalyst having hydrodesulfurization activity, and at hydrotreating conditions, thereby producing a light fraction which is substantially free of sulfur; and (iii) blending said hydrotreated light fraction with said heavy fraction, thereby resulting in a distillate stream having less than about 500 wppm sulfur and having relatively high lubricity.

2. The process of claim 1 wherein the distillate feedstream is a diesel fuel stream boiling in the range of about 160° to about 400° C.

3. The process of claim 1 wherein the distillate feedstream is a jet fuel stream boiling in the range of about 180° to about 300° C.

4. The process of claim 1 wherein the light fraction contains less than about 100 wppm sulfur and represents a boiling range cut of from the initial boiling point of the stream to about 70 vol. %.

* * * * *